US009839243B2

(12) United States Patent
Wulf

(10) Patent No.: US 9,839,243 B2
(45) Date of Patent: Dec. 12, 2017

(54) CONSTRAINED JOINT PROTECTOR

(71) Applicant: Corey Wulf, Edina, MN (US)

(72) Inventor: Corey Wulf, Edina, MN (US)

( * ) Notice: Subject to any disclaimer, the term of this patent is extended or adjusted under 35 U.S.C. 154(b) by 174 days.

(21) Appl. No.: 14/507,402

(22) Filed: Oct. 6, 2014

(65) Prior Publication Data

US 2015/0189928 A1 Jul. 9, 2015

Related U.S. Application Data

(60) Provisional application No. 61/924,616, filed on Jan. 7, 2014.

(51) Int. Cl.
*A41D 13/08* (2006.01)

(52) U.S. Cl.
CPC ..... *A41D 13/081* (2013.01); *A41D 13/087* (2013.01)

(58) Field of Classification Search
CPC ..... A42D 13/087; A61F 13/105; A41D 19/00; A41D 19/02
See application file for complete search history.

(56) References Cited

U.S. PATENT DOCUMENTS

| | | | | |
|---|---|---|---|---|
| 1,388,618 | A * | 8/1921 | Stein et al. | 2/21 |
| 5,450,626 | A * | 9/1995 | Sorrels | 2/21 |
| 5,963,985 | A | 10/1999 | Behr et al. | |
| 6,049,905 | A * | 4/2000 | Owens | 2/16 |
| 7,784,110 | B2 | 8/2010 | Jourde et al. | |
| 8,181,275 | B2 | 5/2012 | Saturnio | |
| 2006/0253952 | A1* | 11/2006 | Caudillo | 2/21 |
| 2012/0284892 | A1 | 11/2012 | Szurley et al. | |

* cited by examiner

*Primary Examiner* — Sally Haden
(74) *Attorney, Agent, or Firm* — Winthrop & Weinstine, P.A.

(57) ABSTRACT

A protective guard for protecting a body joint, the protective guard comprising: a first body having a first end and a second end; a second body having a first end and a second end, the second body rotatably connected to the first body at the second end of the first body, the first body and the second body defining an opening therebetween; and an extension member that extends distally from the first body towards the second body across the opening, wherein the extension member has a curvilinear profile with an apex aligned with the body joint. The extension member allows movement of the body joint while protecting the joint from direct impact.

14 Claims, 4 Drawing Sheets

CONSTRAINED JOINT PROTECTOR

CROSS-REFERENCE TO RELATED APPLICATIONS

This application claims priority to provisional application 61/924,616 entitled "Constrained Thumb Protector," filed Jan. 7, 2014, which is hereby incorporated herein in its entirety.

FIELD OF THE INVENTION

The present invention relates to protective guards for the hand for use during activities, such as athletic activities, which may create a risk of damage or injury, and in some cases further injury, to one or more rays of the hand.

DESCRIPTION OF THE RELATED ART

Protective guards of the prior art typically describe devices that attach externally to a protective glove (for example, U.S. Pat. No. 8,181,275 to Saturnio; US Pat. Pub. No. 2012/0284892 to Szurley et al; U.S. Pat. No. 7,784,110 to Jourde et al, which are hereby incorporated herein in their entireties), but fail to conform anatomically to the thumb. These designs prevent close proximity of the protective apparatus to the hand and incomplete protection due to increased clearance between the thumb and rigid protective element.

Most prior art designs of protective guards protect primarily from direct impact to the dorsal surface of the thumb. This leaves the thumb vulnerable to injuries from direct impact on the volar surface, especially the volar aspect of the distal phalanx when the thumb is in an extended position. U.S. Pat. No. 5,963,985 to Behr et al, which is hereby incorporated herein in its entirety, encapsulates the tip (distal phalanx) of the thumb and addresses volar impact, but it is primarily designed to "absorb shock directed to the tip of the thumb in a direction substantially parallel to the long axis of the thumb". It does so in a rigid manner and does not allow any physiologic movement of the thumb. Flexion of the interphalangeal joint is essential for gripping of the stick.

Prior art is designed to prevent hyperextension only, typically described as the direction opposite of flexion. This fails to account for ligamentous injuries to the articular joints in all directions both physiologic and non-physiologic. Specifically, U.S. Pat. No. 8,181,275 to Saturnio and U.S. Pat. No. 7,784,110 to Jourde et al, do not prevent radial deviation of the metacarpal-phalangeal joint and subsequent injury to the ulnar collateral ligament. There is a need, therefore, to allow physiological movement of the thumb, while preventing volar impact and ligamentous injuries to the articular joints.

BRIEF SUMMARY OF THE INVENTION

The protective guard of the present invention incorporates static or fixed positioning of the metacarpal, proximal phalanx, and metacarpophalangeal joint of a ray of the hand with a linked, articulated distal phalanx protective portion which allows for full functional flexion and limited extension of the inter-phalangeal joint. Protected flexion and extension of the inter-phalangeal joint may be accomplished by a curved dorsal extension from the metacarpal/proximal phalanx protective element that abuts the distal phalanx protective element as the inter-phalangeal joint increases the degrees of extension from a neutral position. The curved dorsal extension from the metacarpal/proximal phalanx protective element also provides protection from direct impact over the dorsal interphalangeal joint when it is in the flexed position. Finally, the current design is to be worn inside a standard protective glove or alone.

In one embodiment, the protective guard for protecting a body joint, the protective guard comprises a first body having a first end and a second end; a second body having a first end and a second end, the second body rotatably connected to the first body at the second end of the first body, the first body and the second body defining an opening therebetween; and an extension member that extends distally from the first body towards the second body across the opening, the extension member having a curvilinear profile comprising an apex, wherein the extension member allows movement of the body joint while protecting the joint from direct impact. The second body may be rotatably connected to the first body with a hinged connection to allow movement of first body relative to the second body. In some embodiments, at least one of the first body and the second body has a curved outer surface and a curved inner surface. At least one of the first body, the second body and the extension may be constructed from a rigid material. The first body may be constructed from the same material as the second body. The extension may be constructed from the same material as the first body or the second body. In some embodiments, the protective guard further comprises a securing strap for securing the guard to the body. The protective guard may have a lining material on an inner surface of at least one of the first body and the second body and/or a gripping coating on an outer surface of at least one of the first body and the second body.

Where the protective guard is used for protecting the interphalangeal joint of a ray of the hand, the first body is a metacarpal portion and the second body is a distal phalanx portion. When the protective guard is positioned about the ray, flexion and extension of an interphalangeal joint is allowed, while providing protection from direct impact. In some embodiments, the metacarpal portion extends from about the carpometacarpal joint of the ray to the metacarpophalangeal joint of the ray. The metacarpal portion may be generally curved and at least partially circumscribes the dorsal, radial and volar sides of the ray.

BRIEF DESCRIPTIONS OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION OF THE INVENTION

The present disclosure relates to novel and advantageous protective guards for hand rays, i.e. the thumb or fingers.

More particularly, the present disclosure relates to novel and advantageous protective guards that allow sufficient physiological movement of the ray, while preventing injury, or further injury, to the ray or ligaments.

Figure 1:
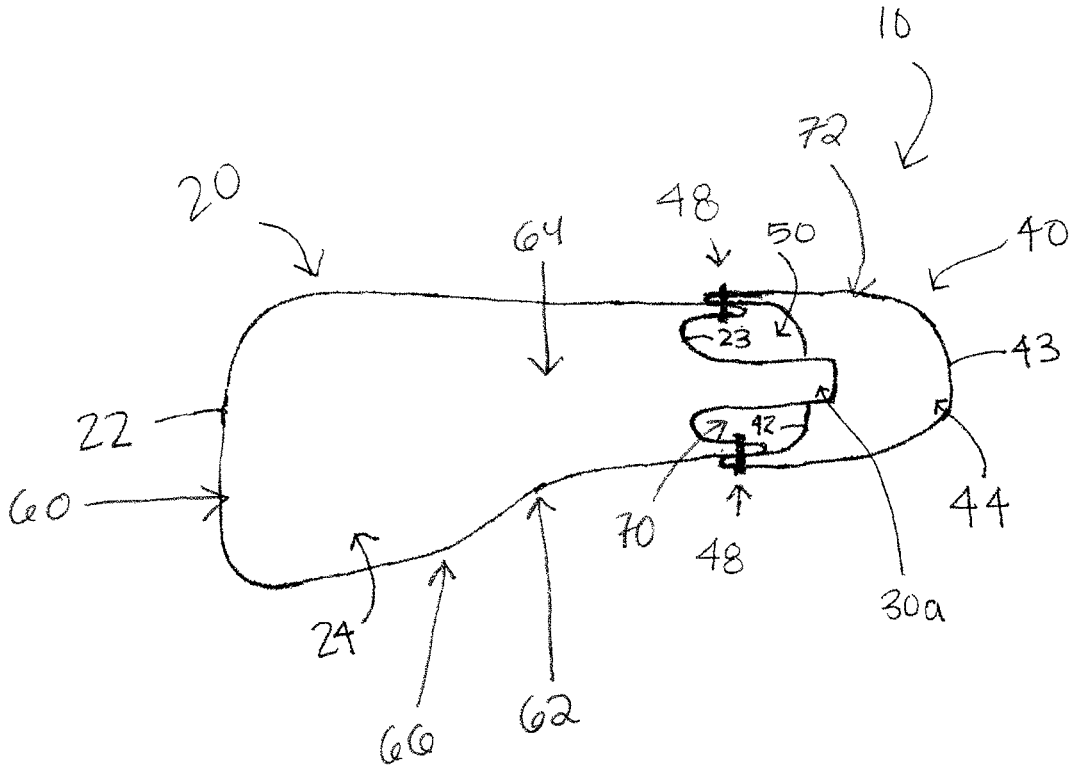
FIG. 1 depicts the dorsal view of one embodiment of a protective guard of the present invention, herein depicted as a right-sided thumb guard.
Figure 2:
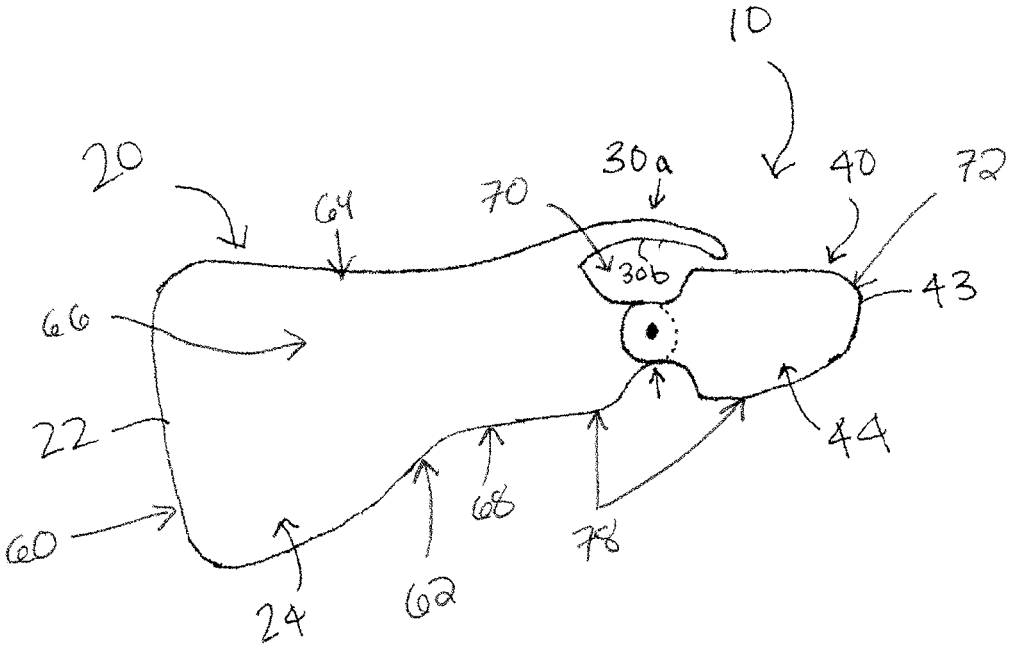
FIG. 2 depicts the radial view of one embodiment of a protective guard of the present invention, herein depicted as a right-sided thumb guard.
Figure 3:
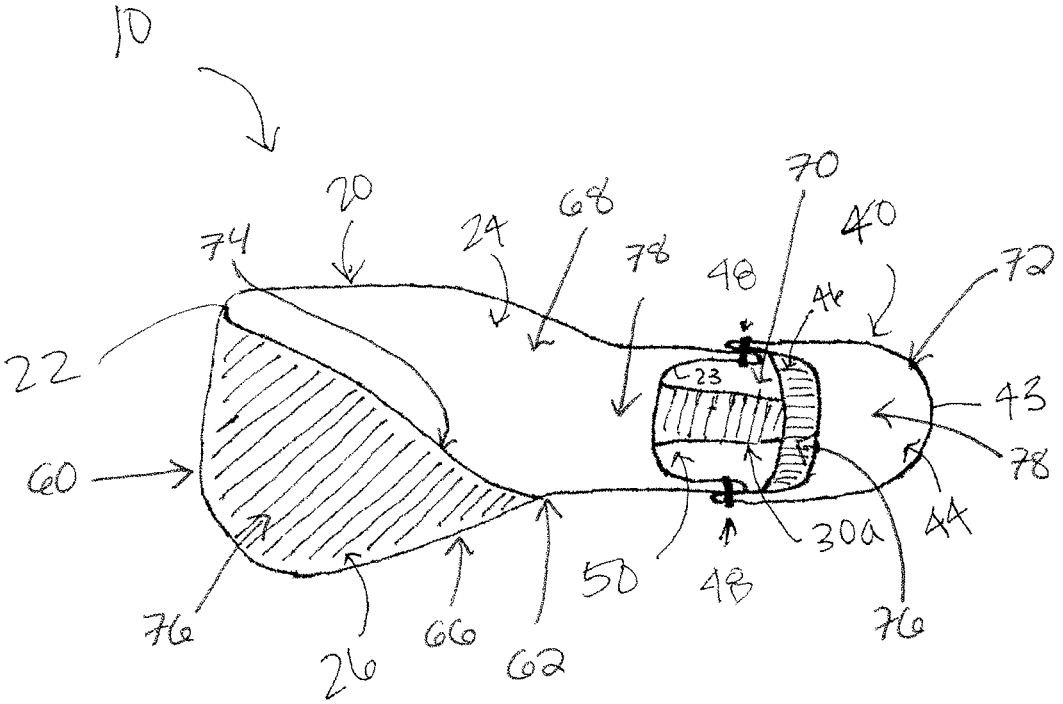
FIG. 3 depicts the volar view of one embodiment of a protective guard of the present invention, herein depicted as a right-sided thumb guard.
Figure 4:
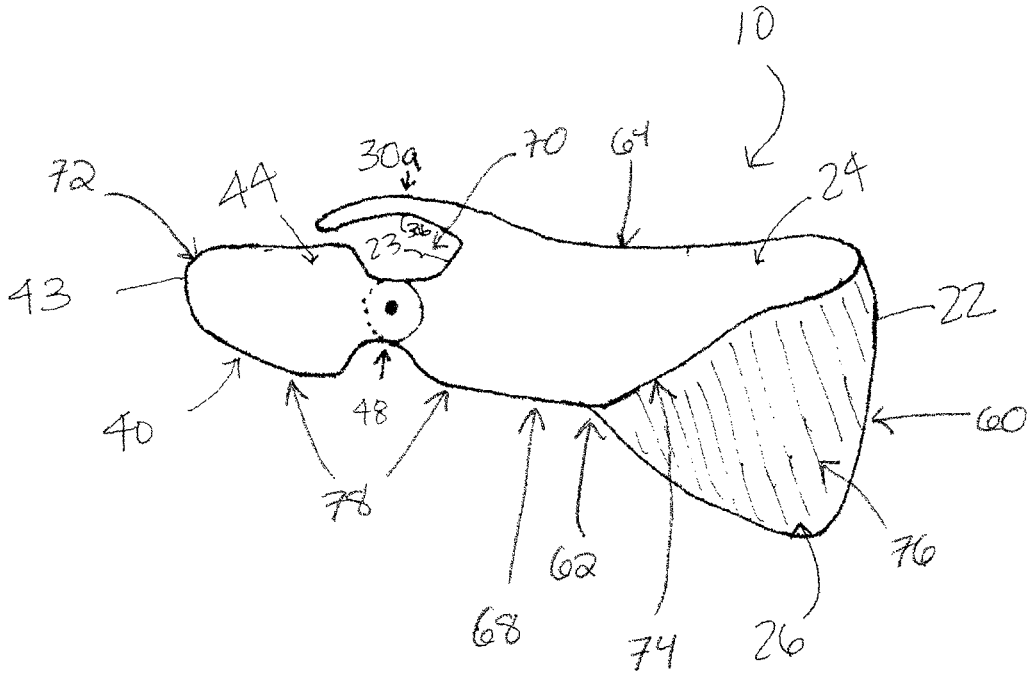
FIG. 4 depicts the ulnar view of one embodiment of a protective guard of the present invention, herein depicted as a right-sided thumb guard.

FIGS. 1-4 show one embodiment of the inventive protective guard 10 disclosed herein. The inventive protective guard may be constructed for protection of a ray on one or both of the right or left hand. In at least the embodiment shown in FIGS. 1-4, the inventive protective guard 10 is constructed for use with the first ray (i.e. thumb) of the right hand, although the device may be used with any ray (i.e. thumb or finger). As shown in FIGS. 1-4, the protective guard 10 comprises a first body 20 and a second body 40. First body 20 and second body 40 may be constructed of metal, plastic, polymer or any combination of such materials. Desirably, first body 20 and second body 40 are constructed of a rigid material, although it is contemplated by the invention that first body 20 and second body 40 are constructed from a flexible material or a shape memory material. In one embodiment, the first body 20 and the second body 40 are constructed from a thermoplastic, which may be porous. In some embodiments, at least one of the first body 20 and the second body 40 may have a thickness of between about 0.03 inches (0.7 mm) and 0.3 inches (7.6 mm), and in one embodiment may have a thickness of about 0.06 inches (1.6 mm).

In at least the embodiment shown, first body 20 is a metacarpal portion and comprises a first end 22, a second end 23 distal from the first end 22, an outer surface 24, an inner surface 26, and a thickness between the outer surface 24 and the inner surface 26. First body 20 is configured to extend between the carpometacarpal (CMC) joint 60 of the first ray 72 at the first end 22 and metacarpophalangeal (MCP) joint 62 of the first ray at the second end 23. In at least one embodiment, the outer surface 24 and the inner surface 26 are curved and at least partially circumscribe the dorsal 64, radial 66 and volar 68 sides of the first ray 72. In at least one embodiment, the first body 20 is configured to statically fix the ray 72 between the CMC joint 60 and the MCP joint 62 in a functional position for grasping or gripping a stick or racquet of typical size that would be utilized in athletic activities, such as lacrosse, hockey, tennis, racquetball, golf, baseball, cricket, ping pong, badminton, hurling, polo, and other athletic activities that use a stick or racquet. The degrees of flexion, extension, abduction, and opposition allowed by the first body 20 for the CMC 60 and MCP 62 joints may be standardized for mass production or customized to fit the specific grip tendencies of an individual athlete. In at least one embodiment for the first ray 72, the construction of first body 20 projects distally from a position on or about the trapezius of the first ray and will be nearly circumferential at the level of the carpal and first metacarpal (covering the dorsal 64, radial 66, and volar 68 sides as shown in FIGS. 1-4) as this allows the user to place the first ray into the protective guard 10 while protecting said structures by the dorsal and volar extensions. As first body 20 projects distally from near the first web space (i.e., the space between the first ray 72 and a second adjacent ray) and it will become circumferentially enclosed on, about, or near the MCP joint 62. The first body, therefore, allows for static or fixed positioning of the metacarpal, proximal phalanx.

As shown in FIGS. 1-4, in some embodiments, a second body 40 is rotatably connected to the first end of the first body 20. The second body 40 is a distal phalanx portion and, in some embodiments, the second body comprises a first end 42, a second end 43 distal from the first end 42, an outer surface 44, an inner surface 46, and a thickness between the outer surface 44 and the inner surface 46. In at least one embodiment, the outer surface 44 and the inner surface 46 are curved and in some embodiments, the second body 40 will enclose the distal phalanx circumferentially, covering the dorsal, volar, radial, ulnar surfaces including the tip as shown in FIGS. 1-4. In at least one embodiment, the rotatable connection 48 of the first body and the second body defines an opening 50 that is aligned with the IP joint 70. The connection 48 may comprise a hinged connection. In the embodiments shown, the first body 20 and the second body 40 are connected to one another on both the ulna and radial sides as shown in FIGS. 1-4. The rotatable connection 48 of the second body 40 to the first body 20 at the level of the IP joint 70 by an articulation composed of a hinged joint that allows motion of the IP joint at least partially within opening 50 and in the directions commonly referred to as flexion and extension in normal IP motion, while protecting the distal phalanx.

First body 20 comprises at least one extension 30*a*. In some embodiments, extension 30*a* projects distally near second end 23 and convexly extends toward the dorsal side of the ray 72, the extension 30*a* having an apex shown generally at 30*b* directed dorsally and centered over the inter-phalangeal (IP) joint 70. The extension 30*a* projects distally toward the IP joint 70. The extension 30*a* allows for flexion and extension of the inter-phalangeal joint 70, while providing protection from direct impact over the dorsal inter-phalangeal joint when it is in the flexed position.

In some embodiments, first body 20 and second body 40 may be connected or tethered to one another on the volar surface via a strap, tether or other similar connection to prevent hyperextension of the IP joint 70, either with or without the extension 30.

In some embodiments, the protective guard is secured to the ray 72 by friction forces or by utilizing one or more securement straps. For example, the first body 20 may be secured to the ray 72 or another position of the hand by a strap 74, or series of straps, that project from the volar surface of the metacarpal portion of the guard in an ulnar, then dorsal, and radial direction to be secured to the dorsal surface of the metacarpal portion of the guard.

At least a portion of the interior surfaces 26, 46 of the first body 20 and the second body 40 may be lined with a lining material 76 to provide better fit and a cushioning of the first ray 72 for the comfort of the user. Further, in some embodiments, at least a portion of the outer surfaces 24, 44 may be manufactured with compressive rubber 78 composite in a varied pattern that allows for better gripping of the athletic stick.

In some embodiments, a device for protecting a hand from injury may comprise one of more protective guards.

The device for protecting a hand from injury may further comprise a glove having an exterior surface and an interior surface. In some embodiments, the protective guard may be fixed to the outer surface of the glove. For example, in one embodiment, the inner surfaces 26, 46 abut the outer surface of the glove. In other embodiments, the protective guard may be fixed to the inner surface of the glove. For example, in one embodiment, the outer surfaces 24, 44 abut the inner surface of the glove. In still other embodiments, the protective guard may be disposed between an inner layer and an outer layer of the glove. In addition to the athletic uses discussed herein, the protective guard may be used alone or with a glove for prevention of injuries while riding bicycles, snowmobiles, racing cycles, motorcycles, all-terrain vehicles, and other off-road vehicles.

Although the embodiments disclosed herein have been described as being used in the metacarpal and distal phalanx regions of the ray of the hand in order to protect the inter-phalangeal joint while allowing movement thereof, it is contemplated by the invention that modifications of the first body and the second body may be made to adapt the design for use with respect to other joints of the body, e.g. elbows and knees.

While certain embodiments have been described in detail, it will be understood that the present disclosure is not limited to such embodiments, but rather includes variations of features described, as well as combinations of features described, which are also included within the spirit and scope of the present invention.

What is claimed is:

1. A protective guard for protecting at least one body joint, the protective guard comprising:

a first body having a first end and the first body having a second end, a portion of the first body having a fully enclosed longitudinal circumference at a location nearer the second end of the first body than the first end of the first body;

a second body comprising a sheath with a fully enclosed longitudinal circumference, the second body having a first end and the second body having a second end, the first end of the second body rotatably connected to the to the second end of the first body by a hinge, the second end of the second body being fully enclosed, the first body and the second body defining an opening therebetween; and the first body comprising an extension member that extends distally from the second end of the first body towards the first end of the second body across the opening and over the hinge, the extension member having a curve, the extension member comprising a first end extending from the first body, the extension member comprising a free second end arranged proximate to and overlapping the first end of the second body, the free second end of the extension member being unattached to the second body, and an apex of the curve being between the first end of the extension member and the free second end of the extension member.

2. The protective guard of claim 1, wherein the first body has a curved outer surface and a curved inner surface.

3. The protective guard of claim 1, wherein the second body has a curved outer surface and a curved inner surface.

4. The protective guard of claim 1, wherein the second body is rotatably connected to the first body with a hinged connection.

5. The protective guard of claim 1, wherein the first body is constructed from a rigid material.

6. The protective guard of claim 1, wherein the second body is constructed from a rigid material.

7. The protective guard of claim 1, wherein the extension is constructed from a rigid material.

8. The protective guard of claim 1, wherein the first body is constructed from a material, and the second body is constructed from the material.

9. The protective guard of claim 1, wherein the second body is constructed from a material, and the extension is constructed from the material.

10. The protective guard of claim 1, further comprising a securing strap.

11. The protective guard of claim 1, further comprising a lining material on an inner surface of at least one of the first body and the second body.

12. The protective guard of claim 1, further comprising a gripping coating on an outer surface of at least one of the first body and the second body.

13. A device for protecting at least one ray of a hand, the device comprising:

at least one protective guard comprising:

a metacarpal portion adapted to extend from about a carpometacarpal joint of the ray to a metacarpalphalangeal joint of the ray, and adapted to protect at least the metacarpalphalangeal joint, a portion of the metacarpal portion having a fully enclosed longitudinal circumference;

a distal phalanx portion comprising a sheath with a fully enclosed longitudinal circumference and rotatably connected to the metacarpal portion at a distal end of the metacarpal portion and a proximal end of the distal phalanx portion by a hinge, a distal end of the distal phalanx portion being fully enclosed, the metacarpal portion and distal phalanx portion defining an opening therebetween; and the metacarpal portion comprising an extension member that extends distally from the second end of the metacarpal portion towards the first end of the distal phalanx portion, the extension member extending distally across the opening and over the hinge, the extension member having a convex curve shape and the extension member comprising a first end extending from the metacarpal portion, the extension member comprising a free second end arranged proximate to and overlapping the first end of the distal phalanx portion, the free second end of the extension member being unattached to the distal phalanx portion, and the convex curve shape having an apex between the first end of the extension member and the free second end of the extension member.

14. The device of claim 13, wherein the at least one protective guard comprises two protective guards coupled together and the device is configured to protect two rays of a hand.

* * * * *